US007240499B1

(12) United States Patent
Shivers, III

(10) Patent No.: US 7,240,499 B1
(45) **Date of Patent: *Jul. 10, 2007**

(54) METHOD FOR TRANSPORTING COMPRESSED NATURAL GAS TO PREVENT EXPLOSIONS

(75) Inventor: Robert Magee Shivers, III, Houston, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 455 days.

This patent is subject to a terminal disclaimer.

(21) Appl. No.: 10/861,993

(22) Filed: Jun. 4, 2004

Related U.S. Application Data

(60) Provisional application No. 60/486,081, filed on Jul. 10, 2003.

(51) Int. Cl.
*F17C 13/08* (2006.01)
*F25J 3/00* (2006.01)

(52) U.S. Cl. ..... 62/53.2; 62/618; 62/50.1; 62/50.2; 62/45.1; 62/48.1

(58) Field of Classification Search ..... 62/50.2, 62/48.1, 50.1, 53.2, 45.1, 618; 114/74
See application file for complete search history.

(56) References Cited

U.S. PATENT DOCUMENTS 3,232,725 A 2/1966 Secord et al. ..... 48/190
3,537,416 A * 11/1970 Cowles ..... 114/74 A
3,830,180 A * 8/1974 Bolton ..... 114/74 A
5,150,812 A * 9/1992 Adams ..... 220/589
6,085,528 A * 7/2000 Woodall et al. ..... 62/45.1

(Continued)

FOREIGN PATENT DOCUMENTS

WO WO/98/59085 6/1998

(Continued)

OTHER PUBLICATIONS

Troner, Alan, (Nov. 2001) "New Energy Technologies in the Natural Gas Sectors: A policy framework for Japan, Technology and Liquefied Natural Gas: Evolution of Markets", James A. Baker III Institute for Public Policy of Rice University, pp. 1-20.*

(Continued)

*Primary Examiner*—Cheryl Tyler
*Assistant Examiner*—John Pettitt
(74) *Attorney, Agent, or Firm*—Buskop Law Group, PC; Wendy Buskop

(57) ABSTRACT

A method for preventing explosions while transporting compressed natural gas by a floating vessel entails obtaining pressurized high-energy content gas; separating the pressurized product stream into saturated gas and liquids; and removing impurities from the saturated gas. The saturated gas is dehydrated forming a dry pressurized gas that is subsequently cooled forming a two-phase gas. The two-phase gas, natural gas liquid, and condensate are loaded onto a storage element forming a mixture. The storage elements are loaded onto the deck to provide open ventilation of the storage element. The floating vessel transports the storage elements to a desired location at a lower cost than comparable submarine pipeline transport costs for distances of less than about 2500 nautical miles while utilizing the vapor phase during transit to power the floating vessel.

26 Claims, 4 Drawing Sheets

U.S. PATENT DOCUMENTS

| | | | | |
|---|---|---|---|---|
| 6,089,028 | A | 7/2000 | Bowen et al. | 62/50.2 |
| 6,237,347 | B1 | 5/2001 | Rigby et al. | 62/41.8 |
| 6,378,330 | B1 | 4/2002 | Minta et al. | 62/613 |
| 6,460,721 | B2 | 10/2002 | Bowen et al. | 220/586 |
| 6,564,580 | B2 * | 5/2003 | Bowen et al. | 62/623 |

FOREIGN PATENT DOCUMENTS

| | | |
|---|---|---|
| WO | WO/99/32837 | 6/1998 |
| WO | WO/00/23756 | 10/1999 |
| WO | WO/00/36332 | 12/1999 |
| WO | WO/00/57102 | 2/2000 |
| WO | WO/0192778 | 5/2001 |

OTHER PUBLICATIONS

Ladkany, S. G. "Composite aluminum-fiberglass Epoxy pressure vessels for transportation of LNG at Intermediate Temperature", Advances in cryogenic materials, vol. 28, Proceedings of the 4th international cryogenic materials conference. Aug. 10-14, 1981. Adn Diego Calif.*

Bennett, C. P. "M-3 Marine Transportation of LNG at Intermediate Temperature". pp. 751-756.

Broeker, Roger J. *American Gas Journal*. "CNG and MLG—New Natural Gas Transportation". *American Gas Journal*, Jul. 1969.

Faridany, Edward K.M., Roger C. Ffooks, and Robin B. Meikle. "A Pressure LNG System". European Offshore Petroleum conference and Exhibition, pp. 245-254.

Faridany E. K., et al. "The Ocean Phoenix Pressure—LNG Systems," pp. 267-280.

Fluggen E. and Dr. Ing. H. Backhaus. "Pressurised LNG—and the Utilisation of Small Gas Fields," pp. 195-204.

* cited by examiner

FIGURE 3
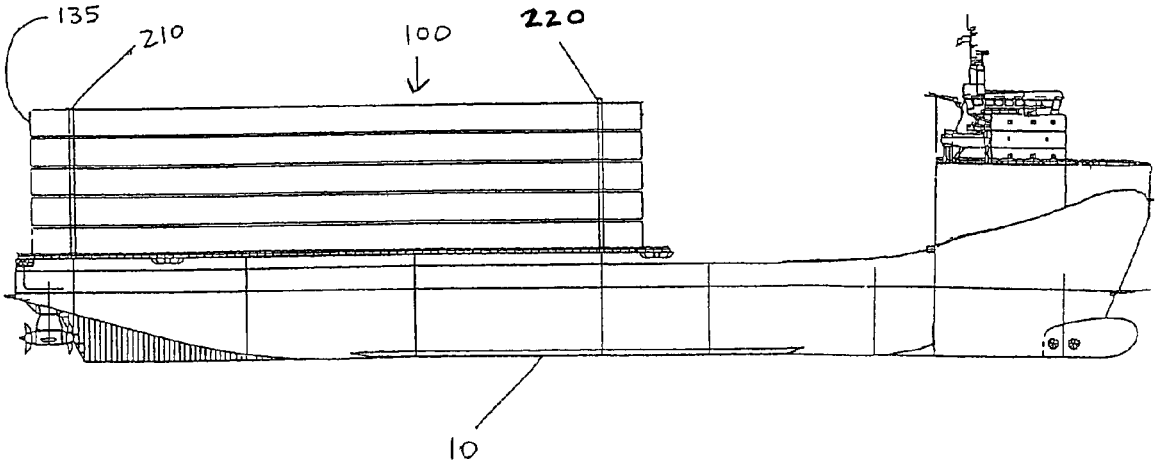
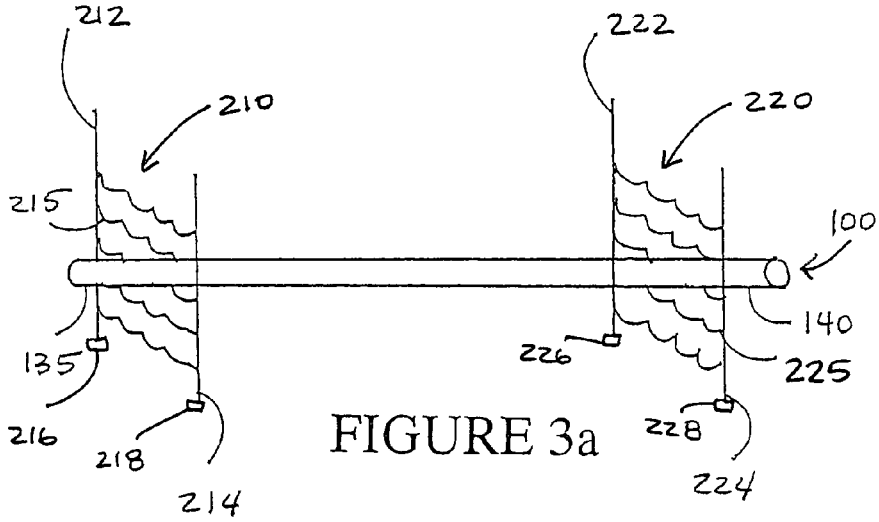
FIGURE 3a

METHOD FOR TRANSPORTING COMPRESSED NATURAL GAS TO PREVENT EXPLOSIONS

The present application claims priority to co-pending U.S. Provisional Patent Application Ser. No. 60/486,081filed on Jul. 10, 2003.

FIELD

The present embodiments relate to a method for providing inventory for expedited loading and transport of compressed natural gas.

BACKGROUND

The current art teaches three known methods of transporting natural gas across bodies of water. A first method is by way of subsea pipeline. A second method is by way of ship transport as liquefied natural gas (LNG). A third method is by way of barge, or above deck on a ship, as compressed natural gas (CNG). Each method has its inherent advantages and disadvantages.

Subsea pipeline technology is well known for water depths of less than 1000 feet. The cost of deep water subsea pipelines is very high and methods of repairing and maintaining deep water subsea pipelines are just being pioneered. Transport by subsea pipeline is often not a viable option when crossing bodies of water exceeding 1000 feet in depth. A further disadvantage of subsea pipelines is that, once laid, it is impractical to relocate.

Liquefied natural gas systems, or LNG systems, require natural gas to be liquefied. This process greatly increases the fuel's density, thereby allowing relatively few numbers of ships to transport large volumes of natural gas over long distances. An LNG system requires a large investment for liquefaction facilities at the shipping point and for regasification facilities at the delivery point. In many cases, the capital cost of constructing LNG facilities is too high to make LNG a viable option. In other instances, the political risk at the delivery and/or supply point may make expensive LNG facilities unacceptable. A further disadvantage of LNG is that even on short routes, where only one or two LNG ships are required, the transportation economics are still burdened by the high cost of full shore facilities. The shortcoming of a LNG transport system is the high cost of the shore facilities which, on short distance routes, becomes an overwhelming portion of the capital cost.

Natural gas prices are currently increasing rapidly due to an inability to meet demand. Unfortunately, the LNG import terminals existing in the United States are presently operating at capacity. New import terminals of the type currently used in the United States cost hundreds of millions of dollars to build. Moreover, it is very difficult and expensive to find and acquire permissible sites for such facilities. Besides the space needed for the import tanks, pumps, vaporizers, etc., large impoundment safety areas must also be provided around all above-ground LNG storage and handling vessels and equipment. LNG import facilities also consume large amounts of fuel, gas and/or electrical energy for pumping the LNG from storage and vaporizing the material for delivery to gas distribution systems.

Compressed natural gas, or CNG, can be transported by way of barge or above deck on a ship. For the method to work, the CNG is cooled to a temperature around −75 degrees Fahrenheit at a pressure of around 1150 psi. The CNG is placed into pressure vessels contained within an insulated cargo hold of a ship. Cargo refrigeration facilities are not usually provided aboard the ship. A disadvantage of this system is the requirement for connecting and disconnecting the barges into the shuttles that takes time and reduces efficiency. Further disadvantages include the limited seaworthiness of the multi-barge shuttles and the complicated mating systems that adversely affect reliability and increase costs. In addition, barge systems are unreliable in heavy seas. Finally, current CNG systems have the problem of dealing with the inevitable expansion of gas in a safe manner as the gas warmed during transport.

The amount of equipment and the complexity of the inter-connection of the manifolding and valving system in the barge gas transportation system bears a direct relation to the number of individual cylinders carried onboard the barge. Accordingly, a significant expense is associated with the manifolding and valving connecting the gas cylinders. Thus, the need has arisen to find a storage system for compressed gas that can both contain larger quantities of compressed gas and to simplify the system of complex manifolds and valves.

Current systems place their cargo of natural gas compressed is the hold of floating vessels. The hold is sealed off as a closed space and then the entire hold is refrigerated. As the refrigerated gas warms during the trip, the released vapor gas tends to collect in the hold causing a dangerous explosion situation. To counter this problem, current system use nitrogen gas systems to displace the vapor gas with inert nitrogen gas. The nitrogen gas system, however, is very expensive and requires increased costs in order to maintain working order. In addition, the nitrogen gas system uses valuable space on the floating vessel that can be used to hold more cargo.

A need exists to transfer compressed natural gas safely across heavy seas to locations greater than 500 nautical miles.

A need exists for a system that can solve the concerns of the inevitable expansion of gas experienced as CNG warms during transport.

SUMMARY

A method for providing inventory for expedited loading and transportation of compressed natural gas entails obtaining pressurized high-energy content gas and separating the pressurized product stream into saturated gas, a natural gas liquid, and a condensate. The method continues by removing impurities from the saturated gas to create a decontaminated saturated gas; dehydrating the decontaminated saturated gas to remove water forming a dry pressurized gas; and cooling the dry pressurized gas forming a two-phase gas having a vapor phase and a liquid phase.

The two-phase gas is then loaded into a storage element located on a floating vessel. The condensate from the separator is also loaded into the storage element forming a mixture. A pressure of 800 psi to 1200 psi is maintained in the storage element. The storage elements are loaded unto the deck of a floating vessel to segregate the storage element from the cargo. The method ends by moving the floating vessel to a desired location at a lower cost than comparable submarine pipeline transport costs for distances of less than about 2500 nautical miles while utilizing the vapor phase during transit to power the floating vessel.

BRIEF DESCRIPTION OF THE DRAWINGS

The present embodiments will be explained in greater detail with reference to the appended Figures, in which:

FIG. 3 depicts a side view of the storage module located on a floating vessel.

FIG. 3*a* depicts a perspective view of one rack and two stanchions of the storage module.

The present embodiments are detailed below with reference to the listed Figures.

DETAILED DESCRIPTION OF THE PREFERRED EMBODIMENTS

Before explaining the present embodiments in detail, it is to be understood that the embodiments are not limited to the particular embodiments herein and it can be practiced or carried out in various ways.

Embodied herein is a method for preventing explosions while transporting compressed natural gas by a floating vessel.

Figure 1:
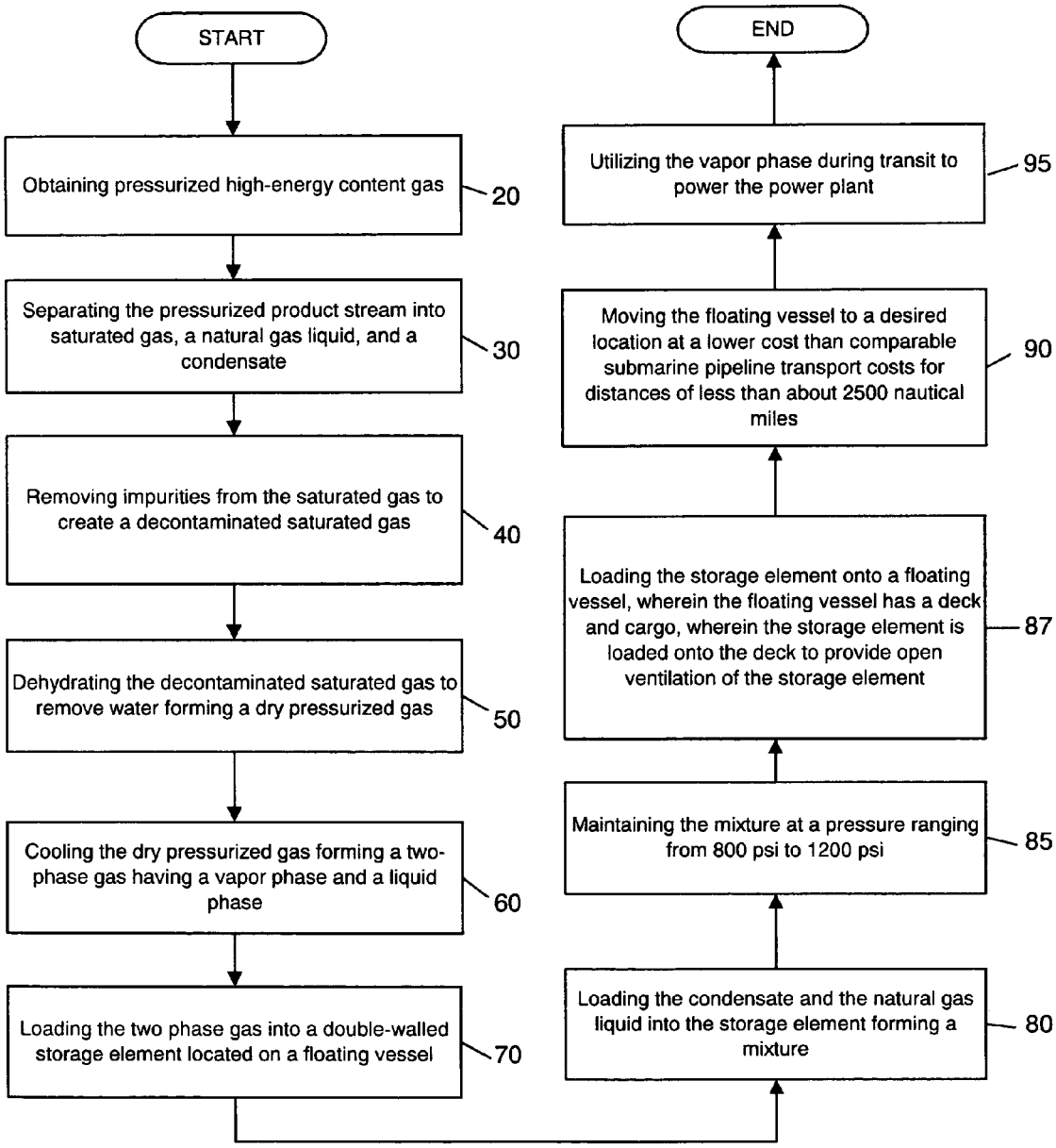
FIG. 1 is a schematic of an embodiment of a method for preventing explosions while transporting compressed natural gas by a floating vessel.

With reference to the figures, FIG. 1 is a schematic of an embodiment of the method. The method for processing and transporting compressed natural gas by a floating vessel begins with obtaining pressurized high-energy content gas (20) and separating the pressurized product stream into saturated gas, natural gas liquids, and a condensate (30). The method continues by removing impurities from the saturated gas to create a decontaminated saturated gas (40), dehydrating the decontaminated saturated gas to remove water forming a dry pressurized gas (50), and cooling the dry pressurized gas forming a two-phase gas having a vapor phase and a liquid phase (60).

The two-phase gas is then loaded into a double-walled storage element (70) followed by the condensate and the natural gas liquids being loaded into the double-walled storage element forming a mixture (80). In the preferred embodiment, the double-walled storage element is located on the floating vessel. In the alternative, the two-phase gas, the natural gas liquids, and the condensate are loaded into the double-walled storage element located on land, then loaded on to the floating vessel. The pressure of the mixture is maintained within the double-walled storage element at a pressure ranging from 800 psi to 1200 psi (85).

The double-walled storage elements are loaded onto a floating vessel. The floating vessel has a deck and cargo. The double-walled storage elements are loaded onto the deck to provide open ventilation of the storage element (87). Placing the cargo on the deck also segregates the storage elements from the other cargo located in the hull of the floating vessel.

Since the double-walled storage elements are designed to keep the contents cold during transport, the elements can be placed on the deck of the floating vessel instead of inside the hold. In addition to having natural ventilation of the storage elements, placing the elements on the deck eliminates the need and extra cost of refrigeration units and nitrogen gas systems. In addition, the risk of explosion decreases since the vapor gas does not collect in the hold.

As shown in FIG. 1, the final step of the method is moving the floating vessel with the loaded double-walled storage element to a desired location. This step of the method is done at a lower cost than comparable submarine pipeline transport costs for distances of less than about 2500 nautical miles (90). The lower cost is up to 50% less than comparable submarine pipeline costs or conventional LNG costs.

As the mixture in the double-walled storage element warms during transit, vapor gas is formed. The vapor phase is used to power the power plant (95). The vapor gas is a high pressure boil-off gas that is blended with diesel fuel to power the power plant.

Figure 2:
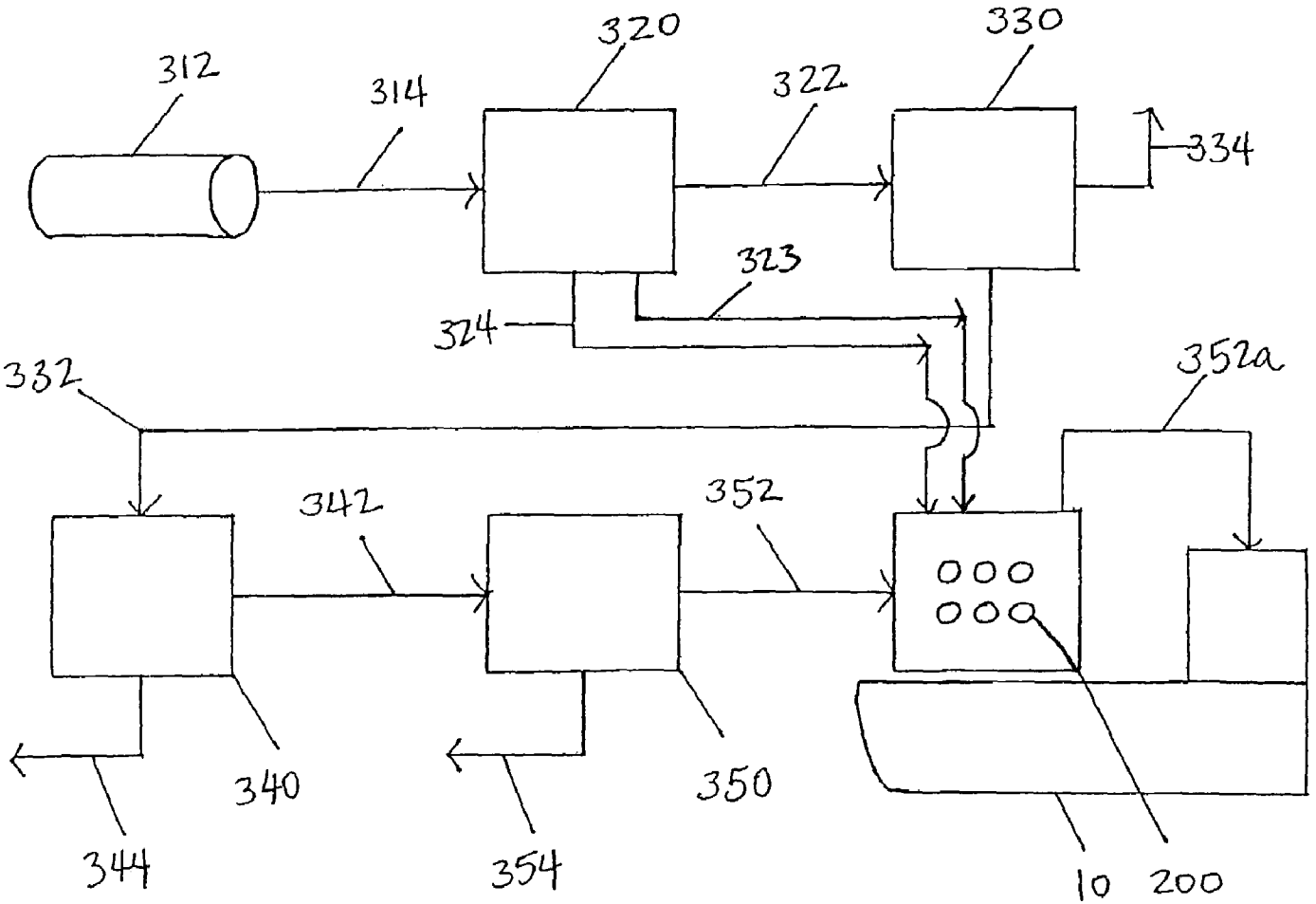
FIG. 2 is a schematic of the system for processing and transporting compressed natural gas.

The components utilized in the method of the invention can be considered as a system. The system is shown in FIG. 2. The system comprises a separator (320) for receiving pressurized high-energy content gas (314) from a pipeline (312). The separator separates the pressurized high-energy content gas (314) stream into saturated gas (322), natural gas liquid, and condensate (324). An example of a separator is a three-phase separation vessel.

The system next involves a decontamination unit (330) connected to the separator (320) for receiving the saturated gas (322). The decontamination unit (330) removes impurities (334) from the saturated gas (322) to form decontaminated saturated gas (332). The types of impurities removed from the saturated gas (322) are CO2, mercury, H2S, and combinations thereof. Examples of decontamination units include an amine contactor, a catalytic bed, a scrubber vessel, or combinations thereof.

As shown in FIG. 2, the next piece in the system of the invention is a dehydration unit (340). The dehydration unit (340) is connected to the decontamination unit (330) and receives the decontaminated saturated gas (332). The dehydration unit (340) removes the water (344), in the form of water vapor, to create dry pressurized gas (342). Types of dehydration units (340) contemplated by the invention include dry bed adsorption units, glycol contact towers, molecular membrane units, or combinations thereof.

The system then includes a chiller (350) connected to the dehydration unit (340). The chiller receives the dry pressurized gas (342) and cools the dry pressurized gas (342) from ambient temperature to a temperature ranging from about −80 degrees Fahrenheit to −120 degrees Fahrenheit forming a two-phase gas having a vapor phase (352) and a liquid phase (354). Examples of chillers (350) are a single-stage mixed refrigerant process and a two-stage cascade system. The chiller (350) is also used to sub-cool the dry pressurized gas (342) to delay the formation of the vapor phase (352).

Continuing in FIG. 2, the system uses at least one storage module (200) located on the floating vessel (10). The storage module (200) is connected to the chiller (350) and the separator (320) and receives the vapor phase (352) of the two-phase gas, the natural gas liquid (323), and the condensate (324). The storage module (200) maintains the vapor phase (352) of the two-phase gas, the natural gas liquid, and the condensate at a pressure ranging from 800 psi and 1200 psi.

The system finally includes a floating vessel (10). The floating vessel (10) is adapted to transport the at least one storage module (200) a distance ranging from about 500 nautical miles to about 2500 nautical miles. The vapor phase (352*a*) that is formed due to the warming of the two-phase gas during transport is used to power the floating vessel (10). Using the vapor phase from the two-phase gas to power the floating vessel both alleviates the environmental concerns of the gas being vented in to the atmosphere and also lowers the cost.

As shown in FIG. 3 and FIG. 3*a*, the storage module is made of a first structural frame (210) with two stanchions (212 and 214) and a second structural frame (220) with two stanchions (222 and 224). Each stanchion has a skid shoe (216, 218, 226, and 228). The skid shoe mountings allow the module to be transported from land to a floating vessel (10) easily. A first rack (215) connects the first and second stanchions (210 and 211). A second rack (225) connects the third and fourth stanchions (212 and 213).

Figure 4A:
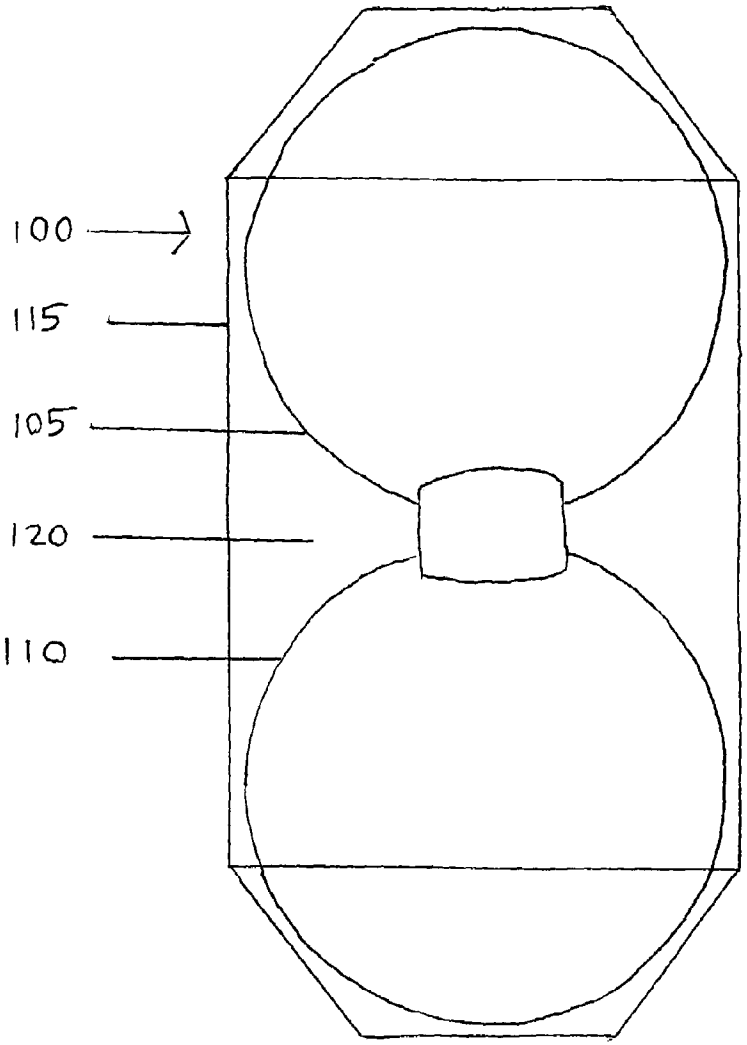
FIG. 4*a* depicts the spherical shape embodiment of the storage element.
Figure 4:
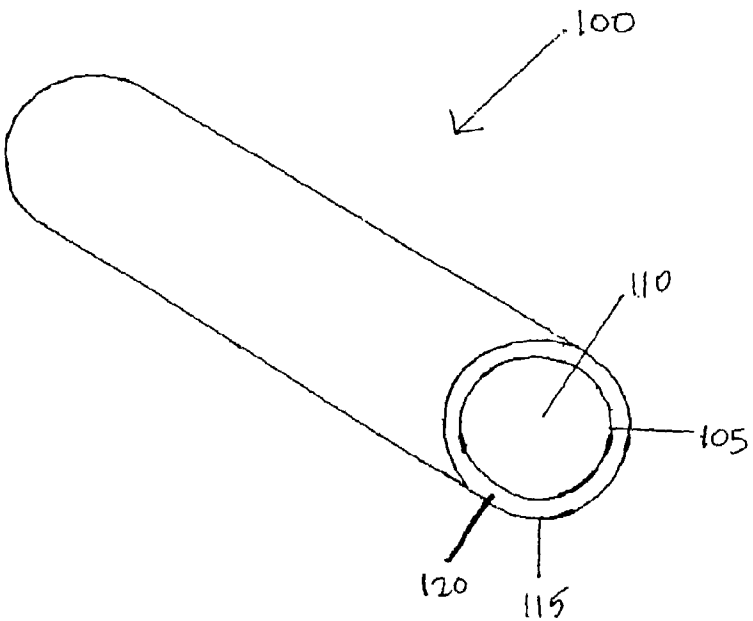
FIG. 4 depicts the cylindrical shape embodiment of the storage element.

Each storage module holds one or more storage elements (100). The storage elements have a first end (135) and a second end (140). An individual storage element (100) is shown in FIG. 4. The storage element (100) has an inner wall (105) forming a cavity (110), an outer wall (115), and an insulation layer (120) located between the inner wall (105) and outer wall (115). The cavity (110) is designed to hold compressed cooled natural gas, natural gas liquid, and condensate.

Returning to FIG. 3 and FIG. 3*a*, the first end (135) of the storage element is supported in the first rack (215) and the second end (140) is supported in the second rack (225).

The storage module supports between three and fifteen storage elements. The weight of the storage module when loaded with at least one empty storage element ranges from 5000 short tons to 8000 short tons.

The structural frames (210 and 220) can support up to five racks between the stanchions. The structural frames (210 and 220) can be located on a floating vessel (10) with a hull wherein the structural frames (210 and 220) extend beyond the hull and are supportable on at least two jetties.

The first and second racks can support up to five storage elements. The rack can further include a plate supported by a plurality of ridges for removably holding the storage element. The rack has an anchor for fixing the storage element at the first end. The second end, or unanchored end, is adapted to travel to accommodate thermal strain.

The storage element's empty weight ranges from 350 short tons to 700 short tons when loaded. Each storage element can have a length up to about 350 feet.

Returning to FIG. 3, the storage elements have the outer wall (115) thinner than the inner wall (105), since the outer wall (115) is not designed to be load bearing. The outer wall (115) can be steel, stainless steel, aluminum, thermoplastic, fiberglass, or combinations thereof. Stainless steel is preferred since stainless steel reduces radiant heat transfer and is fire-resistant and corrosion-resistant.

The construction material for the inner wall (105) is a high-strength steel alloy, such as a nickel-steel alloy. The construction material for the inner wall could be a basalt-based fiber pipe.

The shape of the storage element can either be cylindrical or spherical. The cylindrical shape, as shown in FIG. 4, is a preferred embodiment. The inner wall (105) has a diameter ranging from 8 feet to 15 feet with a preferred range from 10 feet to 12 feet. The outer wall (115) has a diameter that is up to four feet larger in diameter than the inner wall. FIG. 4*a* depicts the spherical embodiment of the storage element.

For the spherical shape, the inner wall has a diameter ranging from 30 feet to 40 feet. The outer wall has a diameter that is up to three feet larger in diameter than the inner wall.

The insulating layer is either perlite or a vacuum.

While these embodiments have been described with emphasis on the preferred embodiments, it should be understood that within the scope of the appended claims these embodiments might be practiced or carried out in various ways other than as specifically described herein.

What is claimed is:

1. A method for preventing explosions while transporting compressed natural gas by a floating vessel comprising the steps:

a. obtaining pressurized high-energy content vapor gas at a first pressure;

b. separating the pressurized high-energy content gas into saturated gas, a natural gas liquid, and a condensate;

c. removing impurities from the saturated gas to create a decontaminated saturated gas;

d. dehydrating the decontaminated saturated gas to remove water forming a dry pressurized gas;

e. cooling the dry pressurized gas forming a two-phase gas comprising a vapor phase and a liquid phase;

f. loading the two-phase gas into a storage element located on a floating vessel, wherein the storage element comprises:

i. a high strength steel alloy inner wall for load bearing purposes forming a cavity;

ii. a stainless steel alloy outer wall for non load bearing purposes; and iii. an insulation layer of perlite disposed between the inner and outer wall, and wherein the cavity is adapted to hold the vapor phase and the liquid phase;

g. loading the natural gas liquid and the condensate into the storage element forming a mixture;

h. maintaining the mixture at the first pressure ranging from 800 psi to 1200 psi;

i. loading the storage element onto a floating vessel, wherein the floating vessel has a deck and cargo, wherein the storage element is loaded onto the deck to provide open ventilation of the storage element; and j. moving the floating vessel to a desired location at a lower cost than comparable submarine pipeline transport costs for distances of less than about 2500 nautical miles while utilizing the vapor phase during transit to power the floating vessel; and discharging the natural gas at the first pressure.

2. The method of claim 1, wherein the step of moving the floating vessel comprises the vapor phase warming during transit forming a high pressure boil-off gas, wherein the high pressure boil-off gas is blended with diesel fuel to power the floating vessel.

3. The method of claim 1, wherein the step of loading the storage element onto a floating vessel further comprises the step of a. placing the at least one storage element into at least one storage module, wherein each storage module comprises:

i. a first structural frame comprising a first stanchion and a second stanchion;

ii. a second structural frame comprising a third stanchion and a fourth stanchion, wherein each stanchion comprises a skid shoe;

iii. at least a first rack connected between the first and second stanchions; and iv. at least a second rack connected between the third and fourth stanchions;

b. loading the at least one storage module onto the deck to segregate the storage module from the cargo.

4. The method of claim 1, wherein the step of removing impurities comprises removing a member of the group consisting of $CO_2$, mercury, $H_2S$, and combinations thereof.

5. The method of claim 1, further comprising the step of loading the two-phase gas into the storage element, wherein the storage elements is disposed on land and then loaded on the floating vessel.

6. The method of claim 1, wherein the outer wall is thinner than the inner wall.

7. The method of claim 1, wherein the inner wall is a high-strength steel alloy or a basalt-based fiber pipe.

8. The method of claim 6, wherein the inner wall is a nickel-steel alloy.

9. The method of claim 1, wherein the outer wall is steel, stainless steel, an aluminum, a thermoplastic, a fiberglass, or combinations thereof.

10. The method of claim 1, wherein the storage element is cylindrical.

11. The method of claim 9, wherein the inner wall comprises a diameter ranging from 8 feet to 15 feet.

12. The method of claim 10, wherein the inner wall comprises a diameter ranging from 10 feet to 12 feet.

13. The method of claim 9, wherein the outer wall comprises a diameter that is Up to four feet larger in diameter than the inner wall.

14. The method of claim 1, wherein the storage element is spherical.

15. The method of claim 13, wherein the inner wall comprises a diameter ranging from 30 feet to 40 feet.

16. The method of claim 14, wherein the outer wall comprises a diameter that is up to three feet larger in diameter than the inner wall.

17. The method of claim 1, wherein the insulating layer is a vacuum.

18. The method of claim 1, wherein the mixture is 90% to 99% liquid phase gas.

19. The method of claim 1, wherein the two-phase gas is cooled from ambient temperature to a temperature ranging from −80 degrees Fahrenheit to −120 degrees Fahrenheit.

20. The method of claim 3, wherein the storage module supports between three and fifteen storage elements.

21. The method of claim 3, wherein the storage module comprises an empty weight ranging from 5000 short tons to 8000 short tons when loaded with at least one empty storage element.

22. The method of claim 3, wherein the first structural frame supports up to five racks between the first and second stanchions.

23. The method of claim 22, wherein the second structural frame supports up to five racks between the third and fourth stanchions.

24. The method of claim 3, wherein the first structural frame is disposed on a floating vessel with a hull and the structural frame extends beyond the hull and is supportable on at least two jetties.

25. The method of claim 3, wherein the first and second racks support up to five storage elements.

26. The method of claim 3, wherein the rack comprises a plate supported by a plurality of ridges for removably holding the storage element and wherein the rack has an anchor for fixing the storage element at a first end, wherein a second end is adapted to travel to accommodate thermal strain.

* * * * *